US005309698A

United States Patent [19]

Huseman

[11] Patent Number: 5,309,698

[45] Date of Patent: May 10, 1994

[54] SNAP AND FILL PLASTIC FILM BAGS AND PROCESS

[75] Inventor: David C. Huseman, Brentwood, Tenn.

[73] Assignee: Packaging Innovations, Inc., Nashville, Tenn.

[21] Appl. No.: 795,288

[22] Filed: Nov. 19, 1991

Related U.S. Application Data

[63] Continuation of Ser. No. 536,528, Jun. 12, 1990, abandoned, which is a continuation-in-part of Ser. No. 513,013, Apr. 23, 1990, abandoned, which is a continuation-in-part of Ser. No. 296,439, Jan. 12, 1989, abandoned.

[51] Int. Cl.[5] ..... B65B 43/26

[52] U.S. Cl. ..... 53/468; 53/459

[58] Field of Search ..... 206/554; 383/9, 10, 383/37, 63, 65; 53/139.2, 390, 459, 468, 469, 571, 572

[56] References Cited

U.S. PATENT DOCUMENTS

| | | | |
|---|---|---|---|
| 3,312,339 | 4/1967 | Million | 53/572 X |
| 3,385,428 | 5/1968 | Kugler | 206/554 X |
| 3,771,645 | 11/1973 | Wendel | 206/554 X |
| 4,046,257 | 9/1977 | Lehmacher | 206/554 X |
| 4,290,467 | 9/1981 | Schmidt | 383/65 X |
| 4,305,503 | 12/1981 | Membrino | 206/554 |
| 4,406,371 | 9/1983 | Membrino | 206/554 |
| 4,458,466 | 7/1984 | Carbone et al. | 206/554 X |
| 4,557,384 | 12/1985 | Membrino | 206/554 |
| 4,560,068 | 12/1985 | Membrino . | |
| 4,630,311 | 12/1986 | Bentson . | |
| 4,846,586 | 7/1989 | Bruno | 383/65 X |
| 4,863,285 | 9/1989 | Claxton | 383/63 X |

FOREIGN PATENT DOCUMENTS

| | | | |
|---|---|---|---|
| 1-97625 | 4/1989 | Japan | 53/469 |

*Primary Examiner*—John Sipos
*Assistant Examiner*—Daniel Moon
*Attorney, Agent, or Firm*—George Pappas

[57] ABSTRACT

Snap and fill plastic film bags and a process of opening and placing product in the plastic film bags. A reclosable zipper is provided at the opening of the bag leading to the bag cavity. A lip extends from the front wall above the reclosable zipper and a header portion extends from the back wall above the reclosable zipper. A part of the header portion is supported on a support structure for carrying the bag and a perforation is provided on the header portion above the reclosable zipper. The bags are initially closed and, during the process of opening and placing product therein, the operator grips the bag front wall lip and by pulling the lip away from the support structure, the complementary zipper profiles are separated and, thus, opening the bag. Further pulling of the lip from the support structure causes the severing of the bag from the header portion at the perforation. Thereafter, the operator places product in the bag cavity through the bag opening and the zipper profiles are joined for closing the bag and sealing the products therein.

17 Claims, 5 Drawing Sheets

SNAP AND FILL PLASTIC FILM BAGS AND PROCESS

FIELD OF THE INVENTION

This is a continuation of copending application Ser. No. 07/536,528 filed on Jun. 12, 1990, abandoned which is a continuation-in-part application of Ser. No. 513,013 filed Apr. 23, 1990, abandoned which is a continuation-in-part of application Ser. No. 296,439 filed Jan. 12, 1989, abandoned.

The present invention, in general, relates to plastic bags of the reclosable type. More particularly, the present invention relates to plastic film bags carried on a support structure and the process by which the bags may be opened and severed from the structure quickly and easily so that the bags may be filled with a given product.

BACKGROUND OF THE INVENTION

Various plastic bags are presently manufactured and are being used for holding and storing all types of materials and items ranging from nuts and bolts to meats and cookies. Such bags are generally made of a thin film of plastic and also range in size and holding capacity. Bags of this character are available to home owners as single bag units. Some such bags include reclosable zippers whereby the bag is selectively openable and closable.

Deli markets and manufacturers of various products also utilize plastic bags for holding and storing their products. In these applications, it is quite often important that the bags be quickly accessible and fillable. Although numerous mechanical means have been devised for filling plastic bags with a desired product, many bag uses, such as in delis, unit dose pill packs, parts packaging by O.E.M.'s, butcher shops, etc., require manual filling of the bags.

In the past, various bags and structures have been devised for such manual filling and for making the bags easily accessible and fillable. In this regard, Membrino, U.S. Pat. No. 4,560,068 discloses pads of plastic bags including a plurality of bag units stacked upon one another and attached at a salvage portion. A score line is provided in the salvage portion adjacent the mouth of the bag so as to permit tearing away of each bag unit from the salvage portion which is connected to a handle portion and, thereafter, for filling as needed. Furthermore, Membrino, U.S. Pat. No. 4,305,503 discloses connecting together the salvage portions so as to resist the forward pull on the lip of a bag as the bag is being torn away so that the bag may more readily be substantially fully opened and severed from the respective salvage portion at the same time. Various plates and bars are disclosed with an upstanding lug for insertion through a central slot and providing a generally A-frame support. As another support structure, a box tray is disclosed whereupon the pad of bags are stapled and making an A-type frame. Another U.S. patent entitled "Block Sealed Flexible Saddle Bags", U.S. Pat. No. 4,733,780 also discloses facilitating the removal of a bag from a stack or block.

These various pads of bags and support structures adapted for manual filling, however, are undesirable and include substantial shortcomings and drawbacks. For example, most such packs require that the bag unit first be completely ripped away from the pack and support structure prior to being able to obtain access to the opening for opening the bag and filling the same. As can be appreciated, this is a two hand operation and, quite often, requires tremendous coordination by the user to properly hold the bag open and fill the same with various size products. Further, even if the bag unit is openable while on the pack or support structure, such as those disclosed in above discussed U.S. Pat. Nos. 4,305,503 and 4,560,068, the user quite often must still rip the bag unit completely off of the pack, shake the bag briskly so as to more fully open the mouth, and then proceed in the filling operation, again with two hands. As can be appreciated, with regard to bag units that are openable while on the pack or support structure and which are, thereafter, ripped off of the pack before filling, the necessary shacking of the bag by the operator so that it may be more fully opened is time consuming. Lost time in shaking open bags becomes substantially significant and increases the cost of the overall manual filling operation. Furthermore, such packs for manual filling operations do not utilize bags with reclosable zippers which are quite often desirable by the end user for selectively opening and closing the bag as desired.

Accordingly, a need exists for bag units in packs, or otherwise, for use in manual filling operations whereby the bag units are easily openable prior to being severed from the pack or structure that they may be fixed upon. A need further exists for a support structure for the bag units or packs whereupon the bags may be opened prior to being severed from the pack or structure preferably using one hand. The bags must also be easily fillable, preferably by a single operator or user using one hand for holding the bag open and the other for dropping the various products therein. The bags should also be easily openable and severable from the pack or structure and must also preferably utilize a reclosable zipper. With regard to bags that are filled after being severed from the pack or the support structure, a need still exists for bag units that are easily openable and require substantially no shaking of the bag for opening, thus, decreasing the time needed for opening the bag, providing an open bag ready for filling and decreasing the overall cost of the filling operation.

SUMMARY OF THE INVENTION

It is the principal object of the present invention to overcome the above discussed disadvantages and drawbacks associated with prior manual filling support structures, bag units and packs.

The present invention overcomes the disadvantages and drawbacks of the prior bag units, packs and support structures by providing bags which are suspendable on a structure or stand. The suspendable bags are made of a plastic film and include a front wall and a back wall that are joined together thereby forming a bag cavity therebetween. An opening is provided between the front and back walls leading to the bag cavity. Complementary separable zipper profiles are provided on the front and back walls at the opening thereby making the plastic bag selectively openable and closable. A lip is attached and extends from the front wall above the zipper profiles. A header portion is attached and extends from the back wall above the zipper profiles and a part of the header portion is suspended or supported on a support structure for carrying the bag. A plurality of identical such bags may be stacked above one another and attached to one another at the header portion, thus creating a bag pack or pad attached at the header.

A perforation is provided on the header portion between the part that is supported on the support structure and the zipper profiles and, also, between the header part whereat a plurality of identical bags are attached to one another and each respective bag zipper.

In the process of opening and placing product in the plastic film bag, unitary plastic film bags or a pack of plastic film bags are placed and supported on a support structure. Initially, the complementary zipper profiles are attached to one another and the bag opening is closed. The front wall lip is initially gripped by the operator and, thereafter, is pulled away from the bag header portion and the support structure and, thus, separating the complementary zipper profiles and opening the bag. By thereafter further pulling the lip away from the support structure and the header portion, the bag is severed from the header portion at the perforation and, thus, the operator has in hand an opened bag generally ready for placing product therein and filling the same. Thereafter, product is placed in the bag cavity through the bag opening and, finally, the complementary separable zipper profiles are joined thereby closing the bag opening and sealing the product within the bag cavity.

The support structure is adapted for suspending or supporting the suspendable bags thereon and includes two upstanding walls connected together at their upper end and a base portion connecting together the two lower ends of the upstanding walls and forming a generally A-frame structure. Suspension pegs are located at the connection of the upper ends of the upstanding walls and extend generally vertically upwardly. The suspension pegs are adapted for being received through the suspension holes of the suspendable bags and retaining the bags on the structure.

For more positively retaining the suspension wall of the bags against the upstanding walls during the step of opening and severing the bag from the suspension wall, an arm is pivotally attached to the suspension pegs at the tip or end thereof. The arm is selectively pivotable for insertion through the suspension holes and for contacting and holding the suspension wall against the support structure upstanding walls. An alternate embodiment includes a threaded bore on the suspension pegs and a screw that is selectively threadingly received in the threaded bore and having a head larger than the bag suspension holes. A clamp may also be provided with or without the suspension pegs for selectively holding the suspension wall against the support structure upstanding wall. In one embodiment, the clamp includes an L-bracket pivotally attached to the upstanding wall and, in another embodiment, includes a strike plate pivotally attached to projections on the upstanding wall. Spring elements are adapted for biasing and retaining the clamp member against the bag suspension walls.

In one form thereof the present invention is directed to a plastic film bag having a front wall and a back wall joined together and defining a bag cavity therebetween. An opening is provided between the front and back walls leading to the bag cavity and complementary separable zipper profiles are provided on the front and back walls at the opening for selectively opening and closing the bag. A lip is attached to the front wall above the zipper profiles and a header portion is attached to the back wall above the zipper profiles. A perforation is provided on the header portion above the zipper profiles.

In one form thereof the present invention is directed to a process of opening and placing product in the plastic film bag. The plastic film bag zipper profiles are initially attached to one another and the bag opening is closed. The bag is supported on a support structure carrying the bag. The process includes the steps of gripping the bag front wall lip and pulling the lip away from the support structure and separating the complementary zipper profiles and opening the bag. The lip is then pulled further away from the support structure severing the bag from the header portion at the perforation. Thereafter, product is placed in the bag cavity through the bag opening and the zipper profiles are joined thereby closing the bag opening.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

Figure 1:
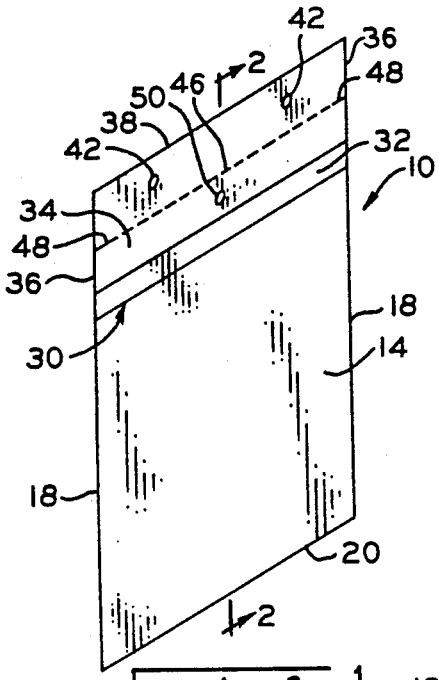
FIG. 1 is a perspective view of a suspendable bag according to the present invention.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

As shown in the drawings, a suspendable bag generally indicated as 10 is adapted to be hung or suspended on a support structure such as that generally indicated as 12. Suspendable bag 10 includes a front wall 14 and a back wall 16. Walls 14 and 16 are made of a thin plastic film of polyethylene or synthetic resin suitable for forming such bags and are generally translucent. Walls 14 and 16 are joined at longitudinal wall seams 18 and bottom seam 20 by heat-sealing or other suitable means. Further, depending on the manufacturing process, walls 14 and 16 may be integral with one another at some of seams 18 and 20, while other of these seams may be joined by heat sealing. For example, if suspendable bag 10 is made from a single ply of plastic material bent at seam 20, seams 18 will be heat sealed, while walls 14 and 16 will be integral at seam 20.

Front wall 14 and back wall 16 further define a bag cavity or chamber 22. Bag cavity 22 is accessible through bag opening or mouth 24. As shown, opening 24 is preferably located between walls 14 and 16 and seam 18 and opposite seam 20 thereby maximizing the bag capacity. However, it is envisioned that bag opening 24 may be in other locations, for example, on front wall 14.

Figure 2:
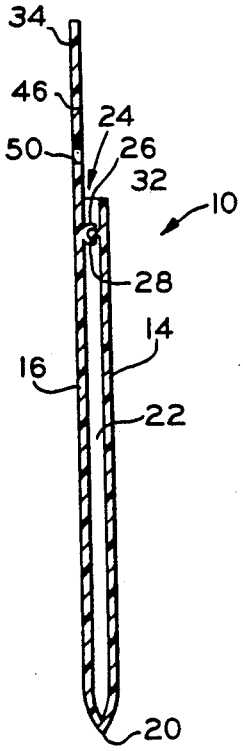
FIG. 2 is a cross sectional cut away view of the suspendable bag shown in FIG. 1 taken along line 2—2.
Figure 6:
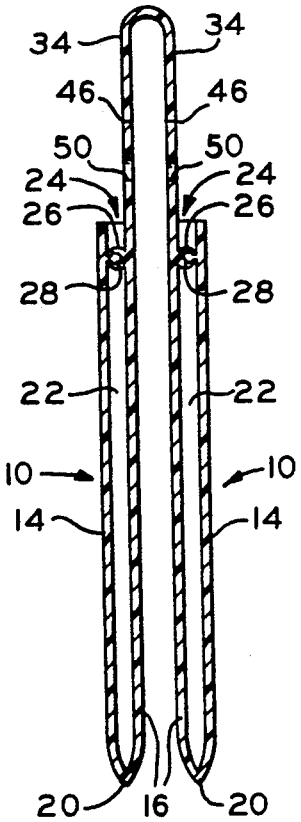
FIG. 6 is a cross sectional view similar to that of FIG. 2, however, showing two suspendable bags attached in a saddle bag fashion.

A reclosable zipper 30, including complementary separable profiles 26 and 28, is provided at opening 24 thereby making bag 10 selectively openable and closable and, thus, also selectively providing access to bag cavity 22. Separable profiles 26 and 28 are preferably located on walls 14 and 16 and are integral therewith. In FIGS. 2 and 6, complementary separable profile 26 is a groove element on back wall 16 and complementary profile 28 is a rib element on front wall 14. The rib and groove elements may, however, be manufactured interchangeably on walls 14 and 16 as needed.

A lip means, preferably in the form of an extension or lip 32, is provided on front wall 14 extending upwardly from reclosable zipper 30. Lip 32 is provided for gripping, for example, by the user between the forefinger and thumb and pulling front wall 14 away from back wall 16. Thus complementary separable profiles 26 and 28 may be separated causing bag 10 to be opened and providing access to bag cavity 22.

Figure 3:
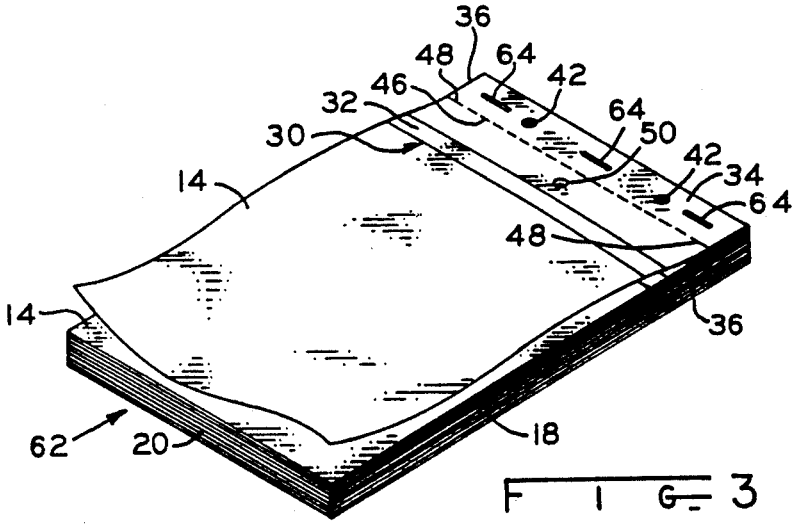
FIG. 3 is a perspective view of a plurality of attached suspendable bags shown in FIG. 1.
Figure 7:
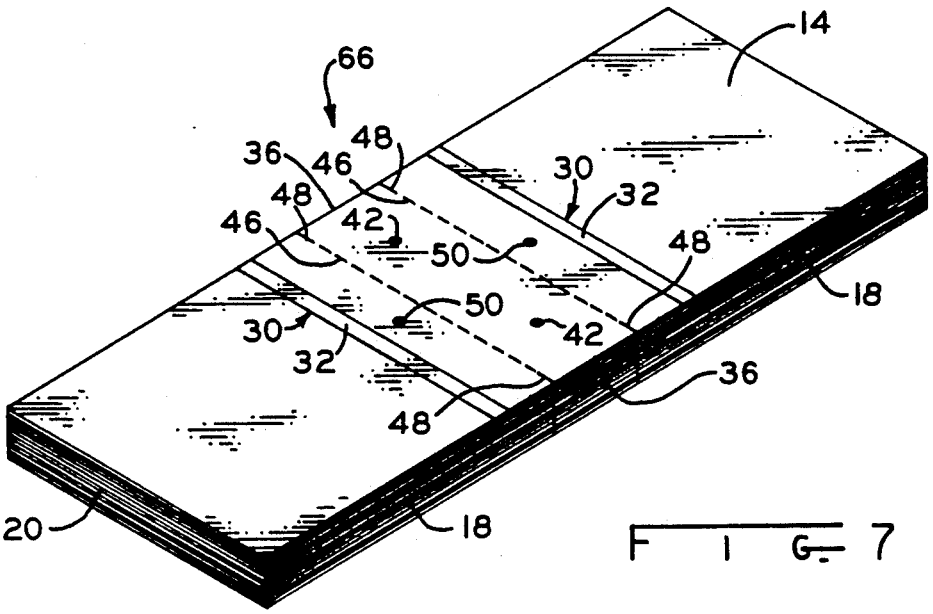
FIG. 7 is a perspective view of a plurality of saddle bag fashion attached bags stacked into a pad over one another; and, FIG. 8 is a perspective view of a plurality of saddle bag fashion attached bags on a support structure and showing the top bag open and hanging by a support element on a support peg.
Figure 8:
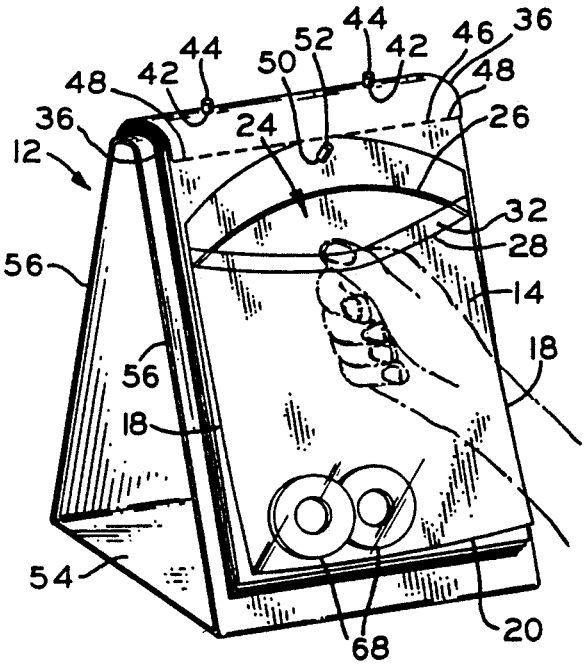

A suspension wall 34 extends upwardly from back wall 16 and is preferably integral therewith as shown in FIGS. 2 and 6. Suspension wall 34 is preferably also of the same width as bags 10 and includes edges 36. In one embodiment, as shown in FIGS. 1–3, suspension wall 34 has a top edge 38 while in another embodiment as shown in FIGS. 6–8, suspension walls 34 of bags 10 are connected or attached together, preferably integrally in a saddle bag fashion.

A suspension means is provided on suspension wall 34 for suspending bag 10 on a structure such as 12. Preferably, the suspension means is a plurality of suspension holes 42 on suspension wall 34. Holes 42 are adapted to receive complementary suspension pegs 44 and, thus, support or retain bag 10 on structure 12.

Suspension wall 34 further includes a perforation means between the suspension means and bag 10 for selectively severing the bag from the suspension means. Preferably a score or perforation line 46 is provided along suspension wall 34 between edges 36 so that bag 10 can be severed or "ripped" from the suspension means. The ends 48 of score line 46 are severed clear through for up to approximately one-half inch from edges 36 so as to aid the severing of bags 10 from the suspension means and to prevent the tearing of seams 18 as bag 10 is opened.

A support means is also provided on the suspension wall between the perforation means and the bag so as to support the bag on structure 12 between the perforation means and the bag. Preferably, the support means includes a support hole 50 between score line 46 and bag 10. Support hole 50 is adapted to receive a complementary support peg 52 located on structure 12.

As briefly mentioned hereinabove, bags 10 are adapted to be suspended on a support structure such as that generally indicated as 12. Structure 12 is substantially triangularly or A-frame shaped and includes a base 54 connected along bends 58 to angularly inclined upstanding walls 56. Upstanding walls 56 are joined or connected together at their upper ends thereof at bend 60. Base 54 and walls 56 are preferably made of sheet metal and are joined at bends 58 and 60, either integrally by bending thereat or, for example, when base 54 and walls 56 are separate sheet metal parts, by other suitable means such as welding. Support structure 12 may also, for example, be made of plastic sheets or cardboard. The width and height of structure walls 56 are adapted for supporting the particular size bags 10, for example, as shown in FIG. 8.

Figure 4:
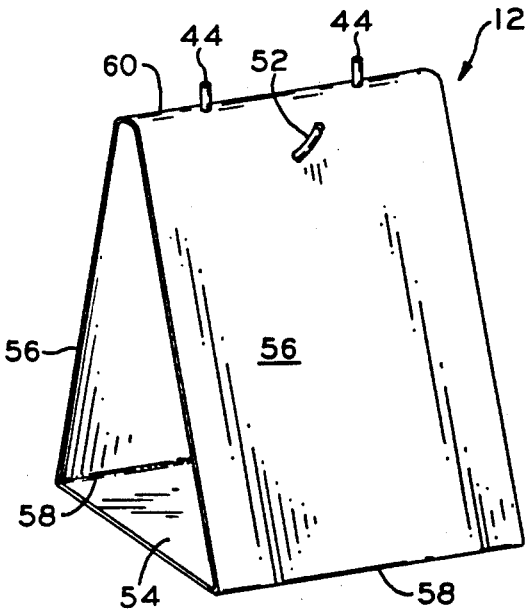
FIG. 4 is a support structure or stand according to the present invention whereupon suspendable bags may be hung or suspended.
Figure 5:
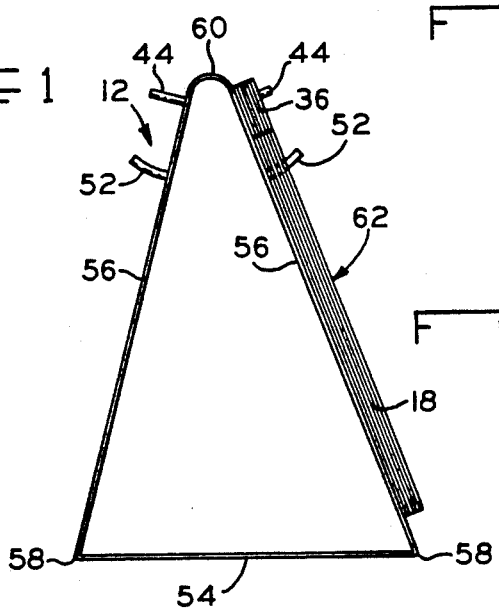
FIG. 5 is a side elevational view of a plurality of suspendable bags suspended on a structure according to the present invention.

Suspension pegs 44 are provided and extend vertically upwardly, as shown in FIG. 4, from the upper ends connection or curved bend 60. In the alternative, suspension pegs 44 may extend perpendicularly outwardly from a wall 56 as shown in FIG. 5. Furthermore, support pegs 52 are connected to walls 56 below the suspension pegs 44 and extend outwardly therefrom substantially perpendicularly. Support pegs 52 are preferably arcuate as shown and biased generally vertically upwardly and away from base 54. Pegs 52 and 44 are attached or connected to structure 12 by welding or other suitable means. It is noted that various structures can be devised, according to the present invention, whereupon suspendable bags 10 can be suspended including pegs attached to building walls or furniture or upstanding walls 56 with suspension and support pegs connected thereto and attachable on building walls or furniture.

Suspendable bags 10 can be individually suspended on a structure 12 such as that shown in FIGS. 4 and 5 and used as needed. In the alterative, a plurality of suspendable bags 10 can be attached together as shown in FIG. 3 at their respective suspension walls on the suspension means side of the perforation means thus making a pad 62 of bags 10. Bags 10 of pad 62 are stacked over one another so that front walls 14 of the stacked bags 10 face in one direction. Bags 10 of pad 62 are attached together and forming a header above score lines 46 through the use of staples 64 that extend through all of the respective suspension walls and bind the same together. In the alternative, suspension walls 34 can be attached together by heat sealing such as, for example, by extending a hot needle therethrough and, thus, attaching the suspension walls by melting. In this regard, it is also envisioned that suspension walls 34 can be attached together at holes 42 in a similar fashion, for example, by extending a hot rod therethrough and melting and attaching suspension walls 34 at holes 42. Other methods of attaching bags 10 for forming pad 62 are envisioned and include tying together with string members. Pad 62 can be supported on structure 12 of FIGS. 4 and 5 similar to that of individual suspendable bags 10, and bags 10 used therefrom as needed.

In another alternative form, as shown in FIG. 6, bags 10 are attached together in a saddle bag fashion and share a common suspension means. These individual saddle bag fashion suspendable bags can be suspended on structure 12 as shown in FIG. 8 with pegs 44 being received through holes 42 and used as needed off of either side of structure 12 or walls 56.

In yet another alternate form, a plurality of saddle bag fashion attached bags, as shown in FIG. 6, are stacked into a saddle bag fashion pad 66 over one another and facing in the same direction as shown in FIG. 7. The plurality of saddle bag fashion attached bags are attached together at the suspension means or between score lines 46 and, thus, forming a header therebetween. As with pads 62, the saddle bag fashion attached bags are attached between score lines 46 by staples, heat sealing, string, or in any other suitable fashion. Pad 66 may then be suspended or placed on structure 12 as shown in FIG. 8 whereat suspension pegs 44 are received through suspension holes 42 and support pegs 52 are received through support holes 50. It should be noted that where holes 50 of pad 66 extend perpendicularly through pad 66, because support peg 52 is arcuate, peg 52 is more readily and properly received through holes 50 as pad 66 is placed on structure 12 because bags 10 at the bottom of pad 66 will tend to extend further downwardly than bags 10 at the top of pad 66.

In operation, whether individual bags 10 as shown in FIG. 1, or pad 62, or saddle bags as shown in FIG. 6, or pad 66 are suspended on a structure 12 as shown in FIGS. 4, 5, and 8, the user or operator can quite easily open, fill, and sever bags 10 as needed. More specifically, in operation, the user initially grips lip 32 and pulls front wall 14 away from back wall 16 and structure 12. Initially, during this pulling, complementary separable profiles 26 and 28 separate, thus, initiating the opening of bag 10. This initial opening occurs because direct tension is provided between the lip 32, reclosable zipper 30, and support hole 50 of suspension wall 34 that is being held back by support peg 52. As the bag is further opened, a pulling force is experienced on edges 36 of suspension wall 34. Accordingly, because the suspension wall portion above perforation line 46 is retained or held back by support pegs 44 and/or the header formed in pads 62 and 66, suspension wall 34 begins to rip along perforation line 46 inwardly from edges 36. This severing or ripping along perforation line 46 is aided by the severed end portions 48 of perforation lines 46. At this point, bag 10 is fully opened and substantially fully severed from the upper portion of suspension wall 34 as shown in FIG. 8. Further, the opening and partial severing was accomplished by merely pulling lip 32 with one hand away from back wall 16.

Upon the opening of bag 10 as described hereinabove, the bag can be retained in an open position by continuing to hold lip 32 away from support peg 52. Thus, the operator using his other hand can place products such as washers 68 or edible goods etc., in bag cavity 22. During this filling process, bag 10 is continued to be supported on structure 12 via support peg 52 and support hole 50, along with one of the operator's hands holding up lip 32. Thus, even substantially heavier products can be placed in bag 10, and bag 10 will continue to be supported via support peg 52 and one of the operators' hands.

Upon completion of the filling step, the operator merely lifts the filled bag 10 up and off of support peg 52 and completely severing bag 10 from the suspension wall portion above the perforation line 46. The separable profiles 26 and 28 are then again brought together and closing bag opening 24 with, for example, washers 68 within cavity 22. This process of using bags 10 by opening, filling, and severing away from structure 12 can continue until a pad 62 or 66 has been depleted or the individually suspended bags have been depleted. Then, the suspension wall portion or header above perforation line 46 is discarded and additional individual bags 10 or pads 62 or 66 are suspended for use on a structure 12.

Figure 15:
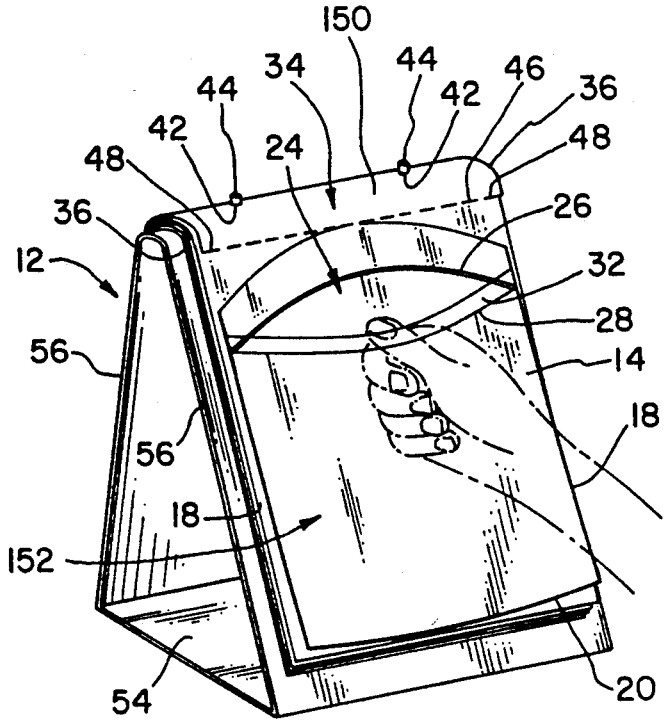
FIG. 15 is a perspective view of a plurality of snap and fill plastic film bags supported on a structure and depicting the process of opening and placing product in the bag according to the present invention; and, FIG. 16 is a perspective view of a plurality of snap and fill bags joined together at the header and ready to be placed on a support structure according to the present invention.
Figure 16:
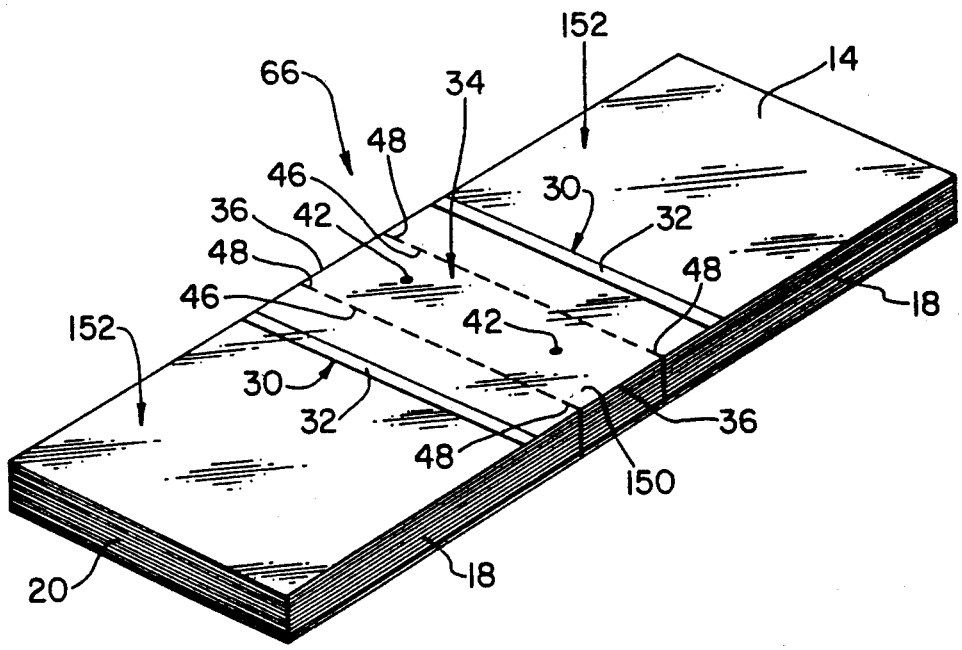

It is occasionally desirable to place product or fill the plastic film bag 10 away from the support structure and without utilizing the support structure support peg 52. In this regard, a snap and fill plastic film bag and process may be utilized. As shown in FIGS. 15 and 16, the snap and fill plastic film bags 152, like bags 10, include a front wall 14 and a back wall 16 joined together by heat sealing, by being integral with one another or by other suitable means and defining a bag cavity 22 therebetween. Bag cavity 22 is accessible through bag opening 24 located between front and back walls 14 and 16. Complementary separable zipper profiles 26 and 28 are provided at opening 24 on the inner surface of front and back walls 14 and 16 for forming a zipper and for selectively opening and closing the bag. A lip 32 is attached to and extends from the front wall 14 above zipper profiles 26 and 28 and is adapted for gripping by the filling operator as shown in FIG. 15. A header portion 34, also referred to as a suspension wall, is attached to and extends from back wall 16 above the zipper profiles 26 and 28. It is noted that as used herein, the word "attachment" includes integral connections. Furthermore, the attachment between lip 32 and front wall 14 and the attachment between header portion 34 and back wall 16 are both preferably of the integral type.

A part 150 of header 34 is supported on a support structure, such as that depicted herein and indicated as 12. As shown in FIG. 15, header portion part 150 includes holes 42 adapted to receive suspension pegs 44 and, thus, the bags 152 are carried upon the support structure. The various suspension means, retention means, clamp means, and equivalents thereof may be incorporated and utilized for supporting part 150 of header 34 upon support structure 12.

The snap and fill plastic film bags include a perforation or score line 46 located between the header portion supported part 150 and zipper profiles 26 and 28. Preferably, to aid in the proper opening, severing, and filling process of these bags, the perforation is parallel to zipper profiles 26 and 28. The perforation and zipper are constructed such that the required force on lip 32 to separate zipper profiles 26 and 28 is less than the force required to sever the bag from the header portion 34 at the perforation 46. Further discussion regarding the construction of the bags and the actions and forces acting thereon for opening and severing the bag from the header is provided hereinbelow.

As shown in FIG. 16, a plurality of the snap and fill bags can be stacked above one another similar to the other suspendable bags discussed herein and may be attached to one another at header part 150 by staples, a hot rod, and/or other suitable means. In FIG. 16 a hot rod was passed through header 34 making holes 42 and attaching the bags to one another thereat.

During storage and prior to the process of opening and filling the snap and fill plastic film bags, zipper profiles 26 and 28 are attached or joined to one another thereby closing the bag opening. The bags are also stored in a flat position as shown in the drawings. Thus, to start the process of opening and placing product in the snap and fill plastic film bags 152, either a unitary, or a plurality of bags 152 which have been attached together and formed into a pad or pack are placed on a support structure 12 so that the bags hang generally downwardly as shown, for example, in FIG. 15. The bags are thus being carried on the support structure at header portion part 150.

With the snap and fill bags on the support structure, the process of opening and placing product in the plastic film bag includes gripping the front wall lip 32 preferably at about the middle thereof as shown in FIG. 15 and, thereafter, pulling the lip away from the support structure. This creates tension between lip 32, zipper profiles 26 and 28, and header 34 which is attached to the support structure. Because the tension required to separate zipper profiles 26 and 28 is less than that required to sever the bag at perforation 46, the complementary zipper profiles are separated and the bag is opened. More specifically, the pulling force on lip 32 creates tension between zipper profiles 26 and 28 generally substantially at the middle of the bag close to where the operator has gripped lip 32. This tension is experienced along profiles 26 and 28, in all likelihood, along a 0.5 to 2 inch length, depending on how the operator has gripped lip 32 and the overall length of the zipper. Prior to zipper profiles 26 and 28 separating, the tension caused by the pulling is experienced in header 34 through generally the middle thereof and is "fanned out" and is experienced by a greater width of header 34 as it travels upwardly. Perforation 46 is strategically placed sufficiently high enough with respect to zipper profiles 26 and 28 so that during the initial pulling and prior to the separation of profiles 26 and 28, the pulling force or tension is experienced along substantially the entire length of perforation 46 and preferably not at edges 36.

The "fanning out" of the tension experienced in header 34 can also be explained by looking at the pulling force per given horizontal length. For example, on a bag that is 6 inches in horizontal length, if 10 pounds of force is applied by the operator at lip 32 and this is experienced along 1 inch of profiles 26 and 28, the resulting force thereon would be 10 pounds per horizontal inch. This force is, however, spread out and experienced by a greater horizontal length as it is transferred through header 34 and towards part 150. Depending on the vertical length between the zipper profiles and perforation 46, if in the present example the force is experienced along 5 inches of the 6 inch total perforation, this would result in an applied force of 10 pounds per 5 inch of horizontal length, or 2 pounds per inch of horizontal length. In this example, to maximize performance, if 10 pounds per horizontal length is needed to separate zipper profiles 26 and 28, the perforation 46 is preferably made so as to sever at something greater than 2 pounds per horizontal length.

During the initial step of pulling on lip 32 and upon reaching the force needed to separate profiles 26 and 28, the profiles at first start to separate generally at the middle of the bag and close to where the operator has gripped lip 32 and is applying the pulling force. Continued pulling on lip 32 causes profiles 26 and 28 to be further separated or "unzipped" toward edges 36 and the bag opened as shown in FIG. 15. It is noted that this pulling force to continue the separation of profiles 26 and 28 and fully open the bag is substantially less than the originally needed force to separate the profiles.

Continued further pulling on lip 32 by the operator causes tension to occur from generally the center part of lip 32 where the operator has gripped lip 32, along lip 32, to the right and left edges 36 and, thereafter, to part 150 attached to the support structure. As can be appreciated, this tension is experienced directly along left and right edges 36 and severed end portions 48 of perforation lines 46. Unlike during the initial opening of the zipper, the pulling force and tension is experienced substantially only along edges 36 and not along the horizontal length of perforation 46 and, therefore, the severing of bag 152 is initiated at edges 36 and continues generally toward the center thereof as lip 32 is further pulled away from the support structure. As shown in FIG. 15, this severing at perforation 46 continues until the bag has been completely severed from header part 150. It is noted that the foregoing discussed pulling forces on lip 32 are normally continuous and are caused by the operator swinging his arm and wrist generally downwardly and away from the support structure 12. At this point, the operator still gripping lip 32 has in hand an opened plastic film bag ready for placing product therein. Further, at this point, the rigidity of zipper profiles 26 and 28 tend to aid in retaining the bag open.

Without having to shake the bag, the operator then places the desired product(s) in the bag cavity 22 through the bag opening 24 and fills the bag as needed. Thereafter, zipper profiles 26 and 28 are again joined thereby closing the bag opening 24 and sealing the product(s) therein.

Figure 9:
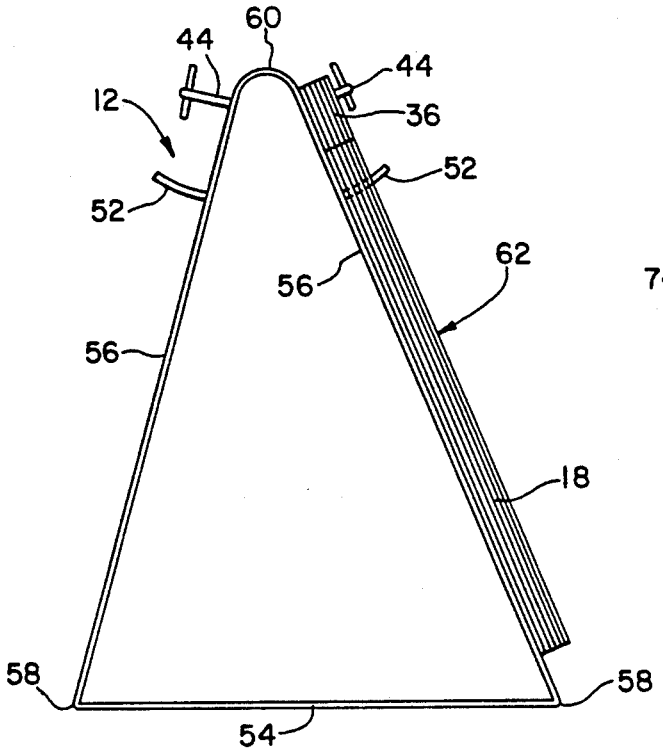
FIG. 9 is a side elevational view of the support structure incorporating a retention member according to the present invention.
Figure 10:
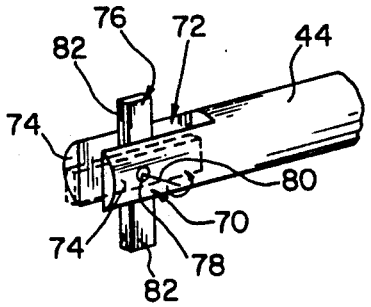
FIG. 10 is a perspective view of the retention member at the end of a suspension peg shown in FIG. 9.

Although suspension pegs 44 function properly to hold back or retain suspension wall 34 during the step of pulling and opening the bag by separating profiles 26 and 28, preferably a retention means and/or a clamp means may be employed to aid in this function. In FIGS. 9–12, there are shown three embodiments of a retention means on suspension pegs 44 for holding the bag suspension wall 34 against the support structure upstanding wall 56. In FIGS. 9 and 10, suspension peg 44, at its outer end 70 thereof, includes a longitudinal slot 72 located between extensions 74. An arm 76 is pivotally attached to extensions 74 via a pin 78 and is adapted to pivot about axis 80 as indicated by the arrow. As shown, arm 76 in this embodiment includes substantially equal in length fingers 82. In operation, for placing a pad 62 or a plurality of individual bags 10 on the structure, arm 76 of FIG. 10 is pivoted in the position shown in dashed lines, and suspension peg 44 is caused to be received within suspension holes 42. The thickness of pad 62 or the number of bags received on suspension pegs 44 is such that, upon applying sufficient force to the area of the suspension wall around the suspension holes 42, arm 76 may be pivoted to a generally perpendicular position as shown in FIG. 9, thus more positively retaining and holding the bag suspension walls 34 against upstanding wall 56. After the suspended bags have all been severed and depleted, the suspension wall portion or header is removed by again placing arm 76 in its longitudinal position shown in dashed lines in FIG. 10.

Figure 11:
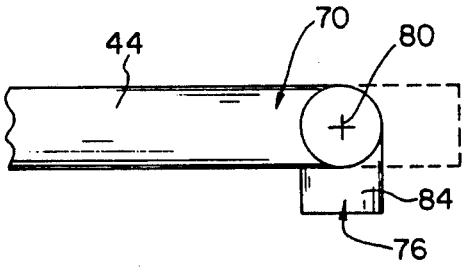
FIG. 11 is a side elevational view of another embodiment of a retention member at the end of a suspension peg according to the present invention.

In another embodiment, as shown in FIG. 11, arm 76 includes a single cantilever portion 84 pivotally attached at the outer end 70 of suspension pegs 44. Cantilever portion 84 is adapted to pivot about axis 80. Portion 84 may be placed in a longitudinal position as shown in dashed lines for receiving or removing the suspension wall 34, and may also be placed in a perpendicular position with respect to suspension peg 44 as shown so as to retain and hold the bag suspension wall against the upstanding wall 56. A spring or biasing element may also be employed for holding cantilever portion 84 in the perpendicular position.

Figure 12:
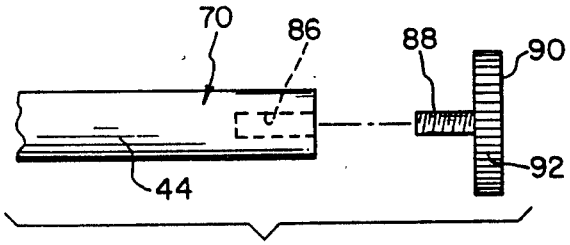
FIG. 12 is a side elevational view of yet another embodiment of a retention member at the end of a suspension peg according to the present invention.

In yet another embodiment, as shown in FIG. 12, the retention means may include a threaded bore 86 located on the outer end 70 of suspension pegs 44. Threaded bore 86 is preferably co-linear with the longitudinal axis of suspension pegs 44 as shown. A screw 88 is adapted to be threadingly received within threaded bore 86 and has a head 90. Head 90 is substantially disk-shaped and includes a knurled outer surface 92 so that it may be easily threaded in and out of bore 86 with one's fingers. In this embodiment, screw 88 is detached from suspension pegs 44 so that pegs 44 may be readily received within suspension holes 42 of pads 62 or individual bags. Head 90 is larger in diameter than the bag suspension holes 42 and, thus, upon the threading of screw 88 within threaded bore 86, head 90 acts to hold the bag suspension walls against the support structure upstanding wall 56.

Figure 13A:
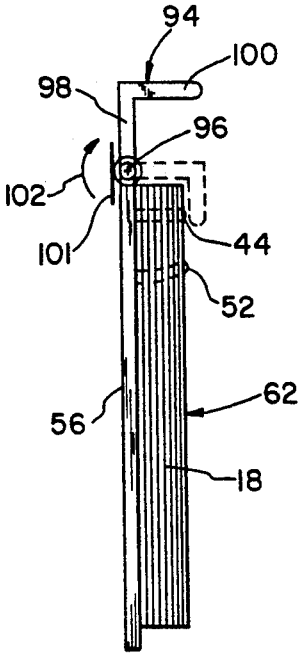
FIG. 13*a* is a side elevational view of a support structure incorporating an L-bracket clamp according to the present invention.
Figure 13B:
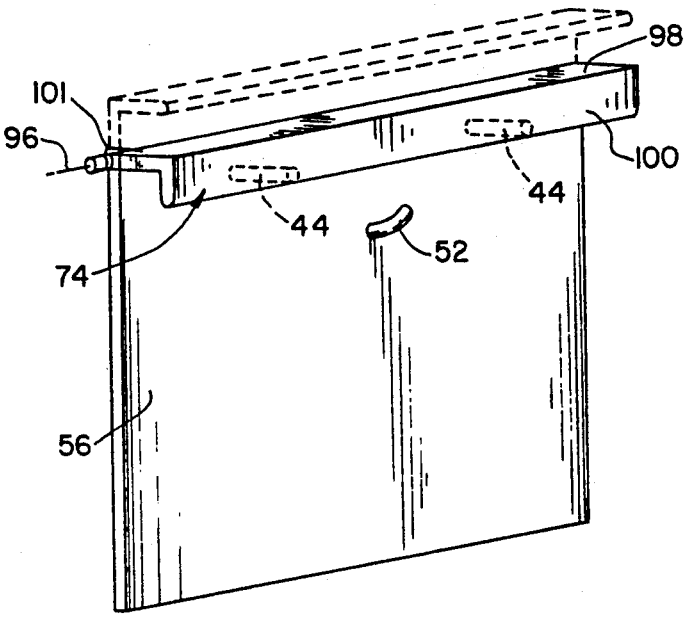
FIG. 13*b* is a perspective view of the support structure shown in FIG. 13*a;*

Rather than a retention means as described hereinabove, a clamp means may be provided for selectively holding the suspension wall 34 against the support structure upstanding walls 56. As shown in FIGS. 13*a* and 13*b*, the clamp means includes an L-shaped bracket 94 pivotally attached to the upstanding wall 56 at the upper end thereof and adapted to pivot about axis 96. More specifically, L-bracket 94 includes extension leg 98 and holding leg 100. L-bracket 94 is pivoted in its upper position as shown in FIG. 13*a* so that pad 62 may be placed in position against upstanding wall 56. Thereafter, L-bracket 94 is pivoted to its position shown in FIG. 13*b*, or as shown in dashed lines in FIG. 13*a*, thus being over the bags suspension walls 34. In this position, holding leg 100 acts to retain or hold the suspension walls 34 against upstanding wall 56. A spring means or element 101 is also provided for biasing the L-bracket as indicated by arrow 102 and, thus, retaining the L-bracket over the suspension walls 34.

Figure 14A:
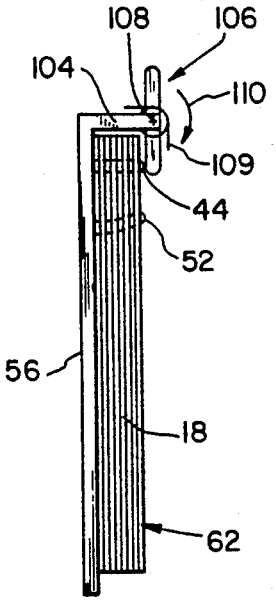
FIG. 14*a* is a side elevational view of a support structure incorporating a strike plate clamp member according to the present invention.
Figure 14B:
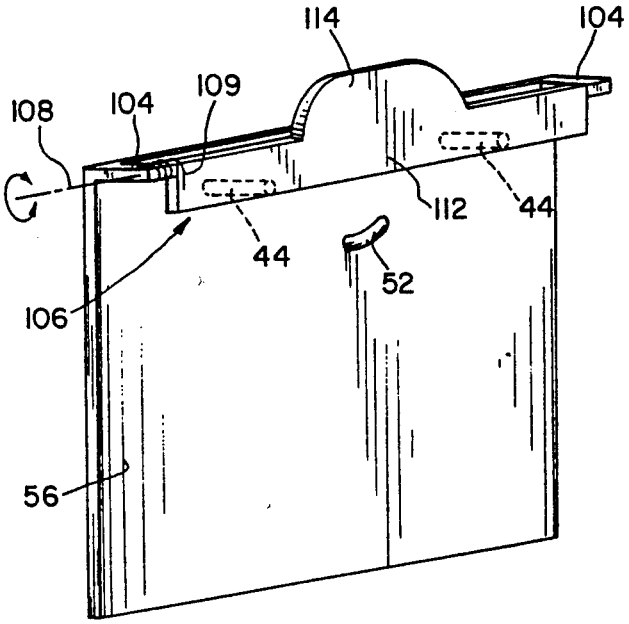
FIG. 14*b* is a perspective view of the support structure shown in FIG. 14*a;*

In another embodiment, as shown in FIGS. 14*a* and 14*b*, two projections 104 are connected to the upstanding wall 56 at the upper end thereof. A strike plate 106 is provided and is pivotally attached between and to both projections 104 as shown in FIG. 14*b*. Accordingly, strike plate 106 pivots about axis 108 as indicated by the arrows. In addition, a spring means or element 109 is provided for selectively biasing the strike plate 106 as indicated by arrow 110 against the bag suspension walls 34. Strike plate 106 includes a lower contact portion 112 and an upper handle portion 114 preferably integrally connected with one another. Strike plate 106 is pivotally attached to projections 104 between contact portion 112 and handle portion 114 s that selective pivotal movement of handle portion 114 causes corresponding opposite pivotal movement of contact portion 112. As mentioned, suspension pegs 44 need not be incorporated in the embodiments utilizing a clamp means. Rather, the clamp means via the biasing force of the spring elements may sufficiently and properly hold the suspension walls 34 against upstanding walls 56. In these embodiments, a torsional spring element is preferred and incorporated for creating the biasing torsional forces 102 and 110.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A process for opening and placing product in a plastic film bag having a front wall and a back wall joined together and defining a bag cavity therebetween, an opening between the front and back walls leading to the bag cavity and complementary separable zipper profiles at the opening for opening and closing the bag, the profiles being joined to one another and the bag opening being closed, a lip attached to the front wall above the zipper profiles, a header portion attached to the back wall above the zipper profiles, a part of the header portion being supported on a support structure for carrying the bag, and a perforation on the header portion extending between header edges and located between the header portion supported part and the zipper profiles, said process comprising the steps of:

gripping a portion of the bag front wall lip;

pulling the lip away from the support structure and creating tension between the complementary zipper profiles substantially near the gripped portion of the lip and initially separating the complementary zipper profiles substantially near the gripped portion of the lip, wherein during this step of creating tension between the complementary zipper profiles substantially near the gripped portion, tension is also created in the header and along the perforation without causing separation of the bag and header thereat;

further causing the complementary zipper profiles to be separated by said pulling and by creating tension along the profiles being separated, thereby opening the bag;

further pulling the lip away from the support structure and causing tension between the gripped portion of the lip and generally along the lip and on the header edges and initially severing the bag from the header along the perforation at the header edges and thereafter along the remaining perforation thereby severing the bag from the header portion; and, placing product in the bag cavity through the bag opening.

2. The process of opening and placing product in a plastic film bag of claim 8 further comprising the step of joining the complementary separable zipper profiles and closing the bag opening after said step of placing.

3. The process of opening and placing product in a plastic film bag of claim 1 wherein during the step of gripping, the front wall lip is gripped at substantially the middle thereof along it horizontal length, and, further wherein during the step of pulling and separating the complementary zipper profiles, the zipper profiles are initially separated at substantially the middle thereof along the zipper profiles horizontal length.

4. The process of opening and placing product in a plastic film bag of claim 1 wherein during the step of creating tension between the complementary zipper profiles substantially near the gripped portion of the lip and during the step of initially separating the complementary zipper profiles, tension is not created along the header edges.

5. The process of opening and placing product in a plastic film bag of claim 1 wherein the zipper profiles of the plastic film bag require a first force per unit length in order to initiate separation thereof and the perforation requires a second force per unit length in order to initiate severance thereof, said first force per unit length being greater than said second force per unit length and wherein during the step of pulling, at least a first force per unit length is applies for initiating separation of the zipper profiles.

6. A process of opening and placing product in a plastic film bag having a front wall and a back wall joined together and defining a bag cavity therebetween, an opening between the front and back walls leading to the bag cavity and complementary separable zipper profiles at the opening for opening and closing the bag, the profiles being joined to one another and the bag opening being closed, a lip attached to the front wall above the zipper profiles, a header portion attached to the back wall above the zipper profiles, a part of the header portion being supported on a support structure for carrying the bag, and a perforation on the header portion extending between header edges and located between the header portion supported part and the zipper profiles, said process comprising the steps of:

gripping a portion of the bag front wall lip;

pulling the lip away from the support structure and separating the complementary zipper profiles and opening the bag;

further pulling the lip away from the support structure and severing the bag from the header portion at the perforation; and, placing product in the bag cavity through the bag opening.

7. The process of opening and placing product in a plastic film bag of claim 6 further comprising the step of joining the complementary separable zipper profiles and closing the bag opening after said step of placing.

8. The process of opening and placing product in a plastic film bag of claim 6 wherein during the step of gripping, the front wall lip is gripped at substantially the middle thereof along its horizontal length and, further, wherein the during the step of pulling and separating the complementary zipper profiles, the zipper profiles are initially separated at substantially the middle thereof along the zipper profiles horizontal length.

9. The process of opening and placing product in a plastic film bag of claim 6 wherein during the step of further pulling and severing the bag from the header portion, the severing of the bag occurs initially along the perforation at the header edges and thereafter extends along the perforation toward the middle thereof until the bag is fully severed from the header.

10. The process of opening and placing product in a plastic film bag of claim 6 wherein during the step of pulling and separating the complementary zipper profiles, tension is not created along the header edges.

11. The process of opening and placing product in a plastic film bag of claim 6 wherein the zipper profiles of the plastic film bag require a first force per unit length in order to initiate separation thereof and the perforation requires a second force per unit length in order to initiate severance thereof, said first force per unit length being greater than said second force per unit length and wherein during the step of pulling, at least a first force per unit length is applied for initiating separation of the zipper profiles.

12. A process of opening a plastic film bag having a front wall and a back wall joined together and defining a bag cavity therebetween, an opening between the front and back walls leading to the bag cavity and complementary separable zipper profiles at the opening for opening and closing the bag, the profiles being joined to one another and the bag opening being closed, a lip extending from the front wall above the zipper profiles, a header portion extending from the back wall above the zipper profiles, and a perforation on the header portion extending between header edges, said process comprising the steps of:

gripping a portion of the bag front wall lip;

pulling the lip away from the header and separating the complementary zipper profiles while the back wall remains attached to the header portion at the perforation;

wherein, during the step of pulling, tension is created along the perforation;

further pulling the lip away from the header and opening the bag, and creating tension along the header edges; and, severing the bag from the header portion at the perforation, initially at the header edges and thereafter along the perforation toward the middle thereof until the bag is fully severed from the header.

13. The process of claim 12 wherein during the step of pulling and separating the complementary zipper profiles, tension is not created along the header edges.

14. The process of claim 12 wherein the zipper profiles of the plastic film bag require a first force per unit length in order to initiate separation thereof and the perforation requires a second force per unit length in order to initiate severance thereof, said first force per unit length being greater than said second force per unit length and wherein during the step of pulling, at least a first force per unit length is applied for initiating separation of the zipper profiles.

15. The process of claim 12 wherein during the step of gripping, the front wall lip is gripped at substantially the middle thereof along its horizontal length and, further, wherein during the step of pulling and separating the complementary zipper profiles, the zipper profiles are initially separated at substantially the middle thereof along the zipper profiles horizontal length.

16. The process of claim 12 further comprising, after the step of severing, the steps of placing product in the bag cavity through the bag opening and joining the complementary separable zipper profiles and closing the bag opening.

17. The process of claim 12 further comprising, after the step of further pulling the lip away from the header and opening the bag, the step of placing product in the bag cavity through the bag opening and, after the step of severing, the step of joining the complementary separable zipper profiles and closing the bag opening.

* * * * *